US010836569B2

(12) United States Patent
Kalitta et al.

(10) Patent No.: US 10,836,569 B2
(45) Date of Patent: Nov. 17, 2020

(54) SYSTEM AND APPARATUS FOR POSITIONING INTERMODAL CONTAINERS ON PALLETS

(71) Applicant: KALITTA AIR LLC, Ypsilanti, MI (US)

(72) Inventors: Conrad Kalitta, Ypsilanti, MI (US); Steven Brewer, Oscoda, MI (US)

(73) Assignee: Kalitta Air, LLC, Ypsilanti, MI (US)

( * ) Notice: Subject to any disclaimer, the term of this patent is extended or adjusted under 35 U.S.C. 154(b) by 602 days.

(21) Appl. No.: 14/874,645

(22) Filed: Oct. 5, 2015

(65) Prior Publication Data

US 2016/0096654 A1 Apr. 7, 2016

Related U.S. Application Data

(60) Provisional application No. 62/060,078, filed on Oct. 6, 2014.

(51) Int. Cl.
*B65D 90/00* (2006.01)
*B65D 88/12* (2006.01)

(52) U.S. Cl.
CPC ..... *B65D 90/006* (2013.01); *B65D 88/129* (2013.01)

(58) Field of Classification Search
CPC .. B65D 90/006; B65D 88/129; B65D 90/048; B65D 19/0095; B60P 7/0892; B60P 7/10; B60P 7/135; B64D 9/003
USPC ..... 206/597
See application file for complete search history.

(56) References Cited

U.S. PATENT DOCUMENTS 1,181,377 A * 5/1916 Dowell ..... B60P 7/0823 224/42.39
1,675,701 A * 7/1928 Fitch ..... B60P 7/13 410/71
2,605,064 A * 7/1952 Davis ..... B64D 9/00 105/345
3,478,995 A * 11/1969 Lautzenhiser ..... B61D 45/001 108/55.5
3,753,407 A * 8/1973 Tilseth ..... B65D 19/44 108/53.3
3,797,691 A * 3/1974 Williams, Jr. ..... B65D 19/16 220/1.5
3,972,500 A * 8/1976 Johnson ..... B60P 7/10 410/104
3,973,684 A * 8/1976 Di Martino ..... B65D 90/0006 206/512
4,010,694 A * 3/1977 Mooney ..... B60P 7/10 410/104

(Continued)

*Primary Examiner* — Ernesto A Grano
(74) *Attorney, Agent, or Firm* — Young Basile Hanlon & MacFarlane, P.C.

(57) ABSTRACT

The invention is a system for positioning and removably securing an intermodal container to an intermodal pallet. The system permits the container's longitudinal centerline to be offset from the longitudinal centerline of the pallet, while still providing sufficient support to the container. The invention is a removable system of adapters for positioning and securing a container to the surface of the pallet, and when the adapters are in place, define longitudinal and lateral boundaries for engagement with an intermodal container. A plurality of strap brace assemblies positioned on one side of the pallet to provide an offset anchor position for a plurality of flexible straps, which secure the container when it is positioned on the pallet.

18 Claims, 7 Drawing Sheets

(56) References Cited

U.S. PATENT DOCUMENTS 4,103,871 A * 8/1978 Patterson, III ..... B60P 7/083 254/266
4,464,089 A * 8/1984 Allen ..... B60P 7/0823 410/101
4,591,307 A * 5/1986 Clive-Smith ..... B60P 7/132 24/287
4,890,565 A * 1/1990 Kelly ..... B63B 25/28 114/72
5,061,130 A * 10/1991 Gadow ..... B60P 7/10 410/104
5,111,950 A * 5/1992 Wylenzek ..... B65D 88/129 108/55.1
5,133,453 A * 7/1992 Fritze ..... B65D 19/44 206/335
5,253,763 A * 10/1993 Kirkley ..... B65D 19/16 206/600
5,551,379 A * 9/1996 Hart ..... A01K 27/003 119/771
5,566,849 A * 10/1996 Goehner ..... B65D 9/14 220/4.33
5,706,738 A 1/1998 Rapeli
5,755,163 A 5/1998 Coats
5,765,707 A * 6/1998 Kenevan ..... B65D 11/18 220/4.28
5,799,812 A * 9/1998 Mansouri ..... B65D 19/18 206/600
5,970,885 A * 10/1999 Polando ..... B65D 19/44 108/55.3
6,210,088 B1 * 4/2001 Crosby ..... B60P 7/132 410/35
6,216,607 B1 * 4/2001 Cuddy ..... B65D 19/0012 108/55.1
6,220,467 B1 * 4/2001 May ..... B60P 3/40 220/1.5
6,364,584 B1 * 4/2002 Taylor ..... B65D 88/022 410/121
6,644,220 B2 11/2003 Gangloff et al.
6,666,635 B2 * 12/2003 Holt ..... B60P 7/0815 410/101
6,709,208 B1 * 3/2004 Lyrstrand ..... B60P 7/132 410/103
6,811,048 B2 * 11/2004 Lau ..... B65D 88/005 206/511
6,821,068 B2 * 11/2004 Facey ..... B60P 7/0838 108/55.1
6,877,939 B2 * 4/2005 Tomkins ..... B65D 88/022 410/34
7,337,908 B2 * 3/2008 Dedmon ..... B65D 77/061 206/600
7,556,463 B1 * 7/2009 Hall ..... B60P 7/0815 410/104
7,896,182 B1 * 3/2011 Hansen ..... B65D 11/1873 220/4.31
7,958,995 B2 * 6/2011 Dedmon ..... B65D 77/061 206/386
8,322,957 B1 * 12/2012 Pennisi ..... B60P 7/12 410/96
8,469,329 B2 * 6/2013 Tygard ..... B65D 19/38 108/55.5
8,505,469 B2 * 8/2013 Liu ..... B65D 19/001 108/50.11
8,857,872 B2 * 10/2014 Olivier ..... B65D 88/123 294/68.1
9,067,521 B1 * 6/2015 Masanek, Jr. ..... B60R 11/00
9,309,025 B2 * 4/2016 Luis y Prado ..... B65D 19/44
9,475,609 B2 * 10/2016 Huber ..... B65D 19/0002
9,487,293 B2 * 11/2016 Noe ..... B60P 7/10
9,758,180 B2 * 9/2017 Sun ..... B61D 3/00
D814,384 S * 4/2018 Richter ..... D12/223
2002/0009346 A1 * 1/2002 Holt ..... B60P 7/0815 410/94
2006/0243690 A1 * 11/2006 Mollard ..... B65D 19/44 211/151
2012/0060725 A1 * 3/2012 Edwards ..... B65D 85/66 108/57.17
2018/0057117 A1 * 3/2018 Brawner ..... B60P 7/0892

* cited by examiner

SYSTEM AND APPARATUS FOR POSITIONING INTERMODAL CONTAINERS ON PALLETS

RELATED APPLICATIONS

This application claims the benefit of U.S. Provisional Application No. 62/060,078 filed on Oct. 6, 2014, which is incorporated by reference herein in its entirety.

FIELD OF THE INVENTION

The invention relates to a system and apparatus for positioning intermodal containers on the surface of pallets for transport, and more particularly, to a system and apparatus for allowing intermodal containers to be secured to pallets offset from the lateral centerline of said pallets.

BACKGROUND AND DESCRIPTION OF THE PRIOR ART

Modern transport of freight relies heavily on the use of standardized cargo containers. Trucks, rail cars, ocean-going vessels and aircraft have all been adapted to accommodate such containers with due regard for their standard dimensions and shape. As a result, the movement of containerized cargo has become reliable and cost-effective. A container may be loaded with cargo at a point of origin, transported by truck to a railway station, transported by rail to a seaport, transported by ship to a remote port, transferred again by road or rail to an airport, and transported by aircraft to a remote airport. Standard containers are well adapted to be carried and secured in all of these different modes of transport. Such containers may be reused, and the cargo which they contain need never be handled or unloaded until the container has arrived at its ultimate destination. It is common for multiple containers to be transported in a single vehicle, car, ship or aircraft, and placed side-by-side and/or stacked vertically.

To facilitate movement and transport of such containers, particularly by air, the containers are commonly secured to pallets having standardized construction and dimensions. In a typical aircraft cargo environment, intermodal containers are placed on pallets by suitable lifting equipment, and then secured to the pallet by adjustable straps which surround the container and attach to opposing sides of the pallet. Pallets of this type are well suited to loading and off-loading from aircraft cargo bays, which are typically equipped with floor rollers permitting the pallet and its container load to be conveniently positioned within the cargo hold.

These systems have been in use for decades and have become the worldwide standard for transport of goods over short and long distances. The containers and pallets are rugged and reusable and have been approved by private and government standard organizations certifying their acceptability and safety. However, as a result, commercial shipping companies are somewhat constrained to the utilization of standardized containers and pallets to conform to shipper and customer expectations and a wide variety of laws and regulations to ensure conformity with the interior dimensions of cargo holds in ships and aircraft.

Devices for locating containers and cargo on pallets are well known in the art, for example, U.S. Pat. No. 6,644,220 to Gangloff et al. and U.S. Pat. No. 5,755,163 issued to Coats. Efforts to create adjustable pallets have also been made, for example, U.S. Pat. No. 5,706,738 issued to Rapeli.

In some cargo-carrying vessels, particularly aircraft, the positioning of these containers may present certain difficulties. The positioning and securement of these containers is time consuming and often difficult to accomplish in field conditions. It is desirable, therefore, to construct a system which permits a method of securement that provides ease of installation in minimal time, while enhancing safety and at the same time minimizing the weight of the overall pallet load. It is likewise desirable to be able to reliably position each container in proper relationship to the pallet on which it is mounted, and to adjust the positional relationship between container and pallet to allow the container's position to be adjusted somewhat in relation to the pallet, so that the container may properly fit within the available cargo space.

The orientation and positioning of containers in aircraft is problematic because of the curvature inherent in the cargo compartments of aircraft as a result of the shape of the aircraft fuselage, which tends to be somewhat circular in cross-section. As a result, rectangular containers, if incorrectly positioned, when palletized, may come into contact with the interior structure of aircraft cargo compartments, creating the potential for damage and limiting the width of the cargo which may be positioned inside aircraft fuselages. It is desirable, therefore, to be able to securely offset standard containers in relation to pallets, thereby allowing side by side positioning of palletized containers in transport vehicles. It is preferable that solutions to this problem incorporate utilization of existing pallet designs, i.e., imposing no requirement for specialized pallets to accommodate containers. It is preferable that existing containers may be secured to existing pallets with the necessary versatility obtained by the use of adapters which may selectively position containers at desired locations on standard pallets.

Accordingly, it is the object of the present invention to provide an improved system to position and secure a standardized intermodal cargo container in an offset relationship to the pallet on which the container is loaded and transported. It is another object of the present invention to provide a system of removable elements which can be temporarily affixed to any standard pallet to facilitate such offset loading, and allowing the pallet to be used in the conventional fashion without such elements or offset. These and other objects of the present invention will be apparent from the summary and description which follows.

SUMMARY OF THE INVENTION

The above and other objects of the present invention are achieved in a preferred embodiment thereof by providing a plurality of specialized adapters positioned at the corners and along one side of a standard intermodal container transport pallet. As utilized herein, the direction "longitudinal" refers to container lengthwise dimensions and directions generally fore and aft in the transport vehicle and the term "lateral" refers to container widthwise dimensions and the direction from side to side in relation to the transport vehicle. While the embodiments herein described are explained in relation to a cargo transport aircraft, the present invention is not so limited and may also be utilized in other transport vehicles, such as trucks, rail cars and ocean-going vessels.

The invention described herein contemplates two or more adapters which are removably positionable at spaced apart locations on the perimeter of a pallet. Preferably, the adapters are secured to the pallet perimeter by locking bars which engage a complimentary track on the perimeter of the pallet.

Each adapter is further configured to removably connect to a socket incorporated in the standard container. Securement means interconnect the adapter to the socket, thereby securing the container in relation to the adapter.

In the embodiment, two or more corner elements are utilized, each element referred to as an "adapter". Each of the adapters is positioned on and removably secured to one corner of a rectangular pallet. Each adapter is configured to be attached to or removed from the pallet, preferably without the need for tools. In the embodiments described herein, locking bars are provided to interconnect the adapters to the pallet. Locking bars serve to interconnect the adapters and the pallet, and permit positioning of the adapters, again without the need for specialized tools. Once in position, the adapters will engage corresponding sockets formed in the containers, thereby restricting vertical, longitudinal or lateral movement of the container in relation to the pallet. The system further comprises a plurality of removable strap brace assemblies which are positioned on one lateral side of the pallet, and which engage straps which secure the container to the pallet. The final elements of the system include a plurality of anchors positioned on the opposite lateral side of the pallet from the strap brace assemblies, and a plurality of flexible restraint straps or webs which extend from the strap brace assembly, over the top of the container, thence connecting to the anchors on the opposing lateral side of the container. Each of said plurality of straps may be tightened using conventional strap-tightening means, to securely hold the container onto the pallet. Because of the geometry of the adapters and the strap brace assemblies, the longitudinal centerline of the container is offset from the longitudinal centerline of the pallet, thereby spacing the outboard wall of the container away from the outboard side of the pallet, and hence, positioning the entire container inboard in relation to the cargo hold of the vehicle in which the combination container and pallet is being transported.

Since the adapters and strap brace assemblies are removable, the pallet may be converted for conventional use, wherein the container is laterally and longitudinally centered on the pallet, i.e., not offset in relation to the pallet.

BRIEF DESCRIPTION OF THE DRAWINGS

The above embodiments of the present invention will be more fully understood from the following detailed description, as well as the accompanying drawings, FIGS. 1-10.

DETAILED DESCRIPTION OF THE PREFERRED EMBODIMENTS

Figure 1:
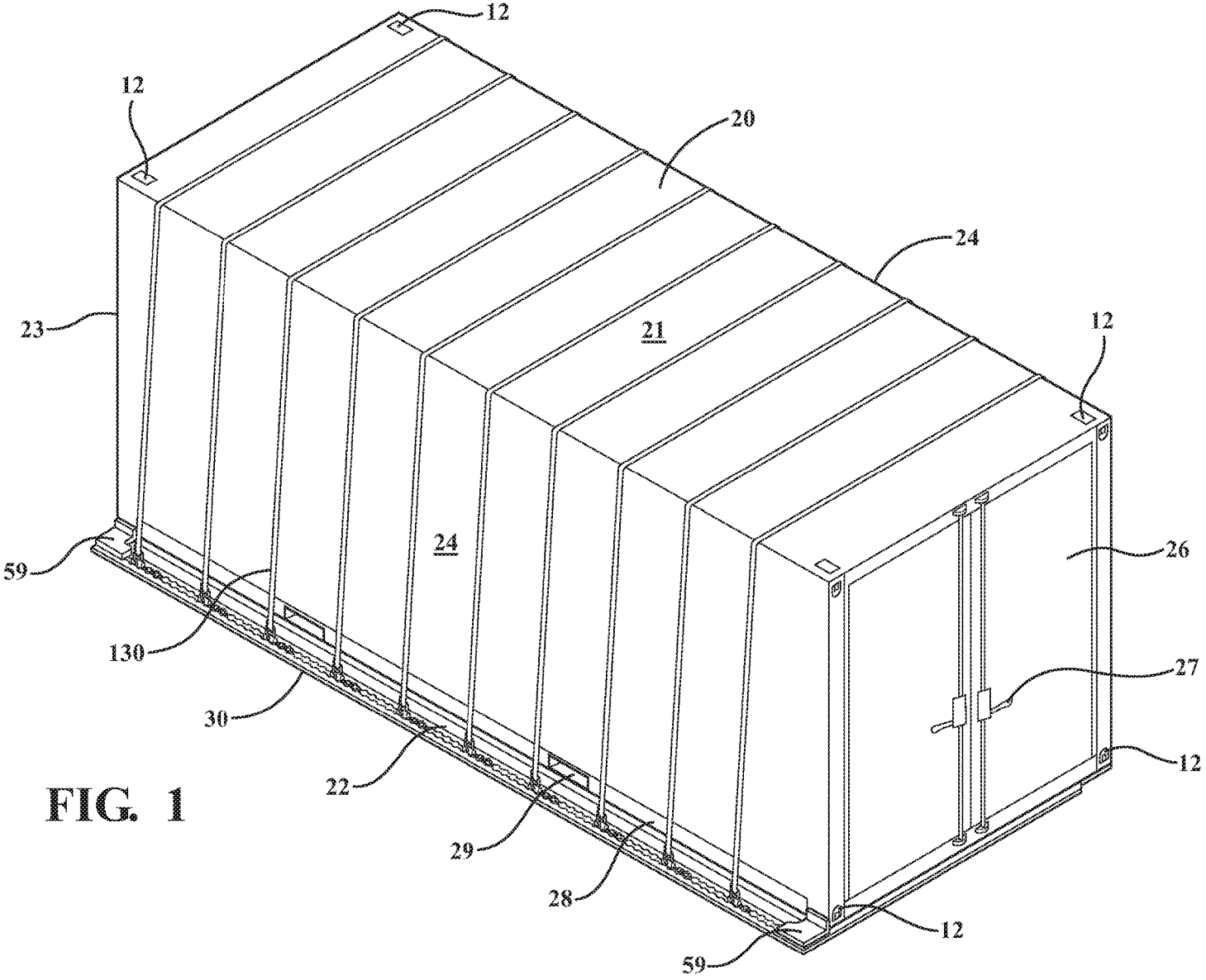
FIG. 1 is a perspective view depicting a container positioned on a pallet in accordance with the present invention.

Referring now to FIG. 1, the basic structure of the invention in relation to an intermodal container 20 will be best understood. The container 20 is typically of rectangular floor plan, having a rectangular top 21, a rectangular bottom 22, rectangular end walls 23 and rectangular side walls 24 forming an enclosure for an interior space. The typical container 20 is constructed of corrugated steel surrounded by a steel framework 28. At least one side wall 24 or end wall 23 of the container 20 is provided with one or more doors 26 or other closeable elements to facilitate loading and unloading of cargo into the interior space of the container 20. Such closeable elements are provided with latching mechanisms 27 to secure the contents of the container 20 during shipment. The base framework 28 is provided with a plurality of openings 29 suitable for accommodating the forks of a forklift truck, and other portions of the framework may be provided with lifting eyes (not shown) to facilitate lifting and movement of the container 20. Each corner of the framework is provided with a socket 12, which allows the containers 20 to be secured to a surface or pallet 30 during transport.

Figure 2:
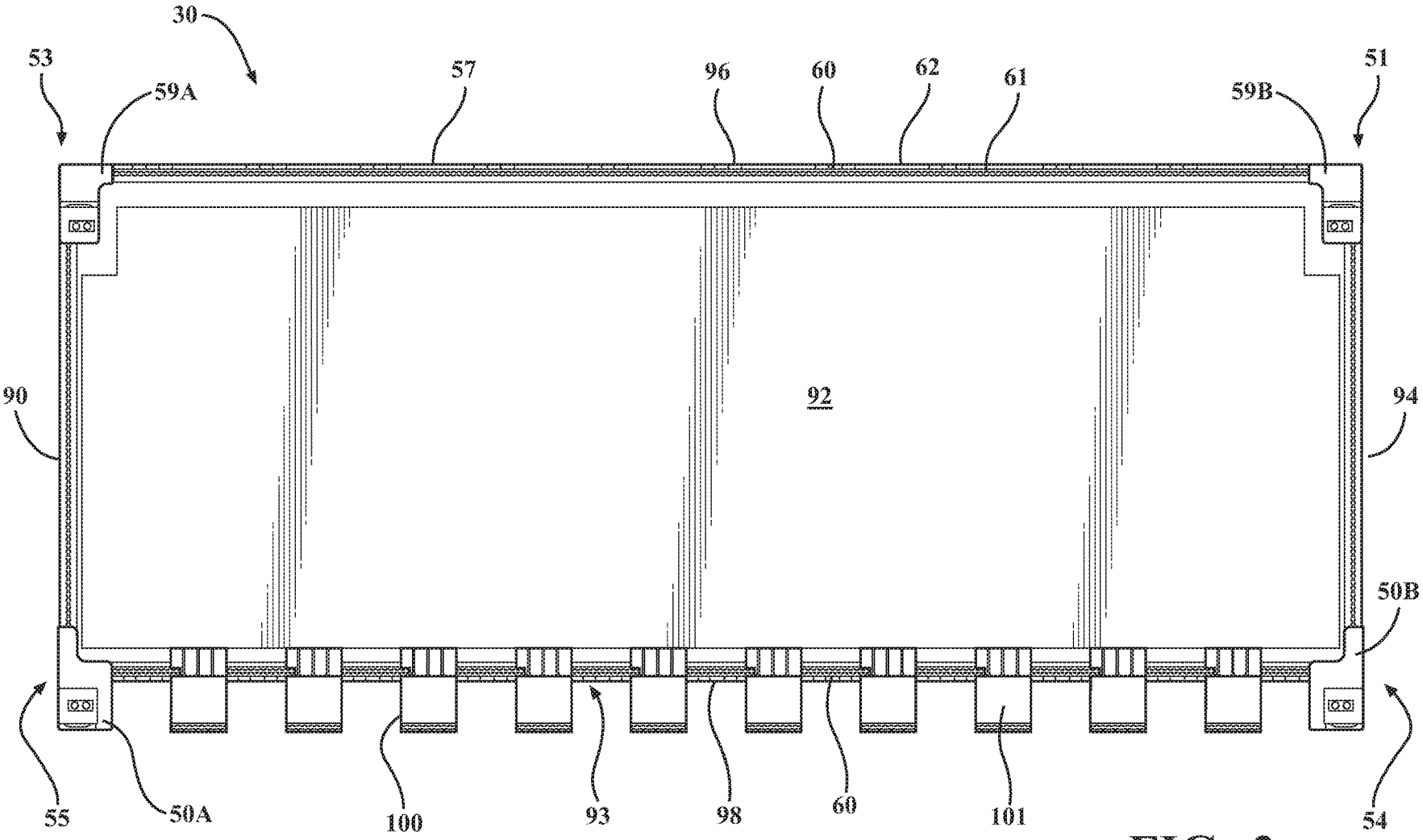
FIG. 2 is a plan view of a typical pallet, showing the adapters and strap brace assemblies of the present invention attached thereto.

FIG. 2 depicts the structure of a standard container pallet 30. The typical container pallet 30 is rectangular in plan, having a top surface 92, a bottom 93, opposing ends 90, 94 and opposing lateral sides 96, 98. Typically, such pallets 30 are constructed of high strength materials such as steel or aluminum, and incorporate an internal framework, covered by a skin. Each pallet 30 is further provided with one or more tracks 60, 62 on its perimeter 57. As can be seen from the figures, the typical track 60, 62 is comprised of a plurality of interconnected cylindrical cavities 61 arrayed on an axis, and extending across the width and along the length of the perimeter 57 of the pallet 30. These tracks 60, 62 are utilized to engage locking bars 6 or other anchor elements having complimentary cylindrical protrusions and a locking plunger 3, which permits the locking bars 6 to be placed in the track 60, 62, positioned anywhere along the length of the track 60, 62, and temporarily locked into position utilizing the locking plunger. A plurality of locking bars 6 is utilized in the present invention to engage and interlock the elements of the system with the pallet 30.

In FIG. 2, the pallet 30 is seen in plan view, and the outboard and inboard mounting adapters 50A, 50B, 59A, 59B, respectively, and strap brace assemblies 100 are pictured as typically disposed around the perimeter 57 of the pallet 30. In the embodiment, a pair of the outboard mounting adapters 50A, 50B, which are mirror images of each other, are positioned at a first outboard corner 54 and a second outboard corner 55 of the pallet 30. Similarly, the inboard mounting adapters 59A, 59B, also mirror images of one another, are positioned at a first inboard corner 53 and a second inboard corner 51 of the pallet 30, as depicted in the figure. The mounting adapters 50A, 50B, and 59A, 59B serve to establish offset positions for the corners of the container 20, thereby orienting and positioning the container 20 laterally in relation to a pallet surface 92. The plurality of strap brace assemblies 100 are removably secured to the pallet upper track 60 and the pallet side track 62, and the position of the strap brace assemblies 100 being selectable along the length of the pallet side track 62 and the pallet upper track 60. Upper surfaces 101 of the strap brace assemblies 100 provide support for the container 20.

Figure 3:
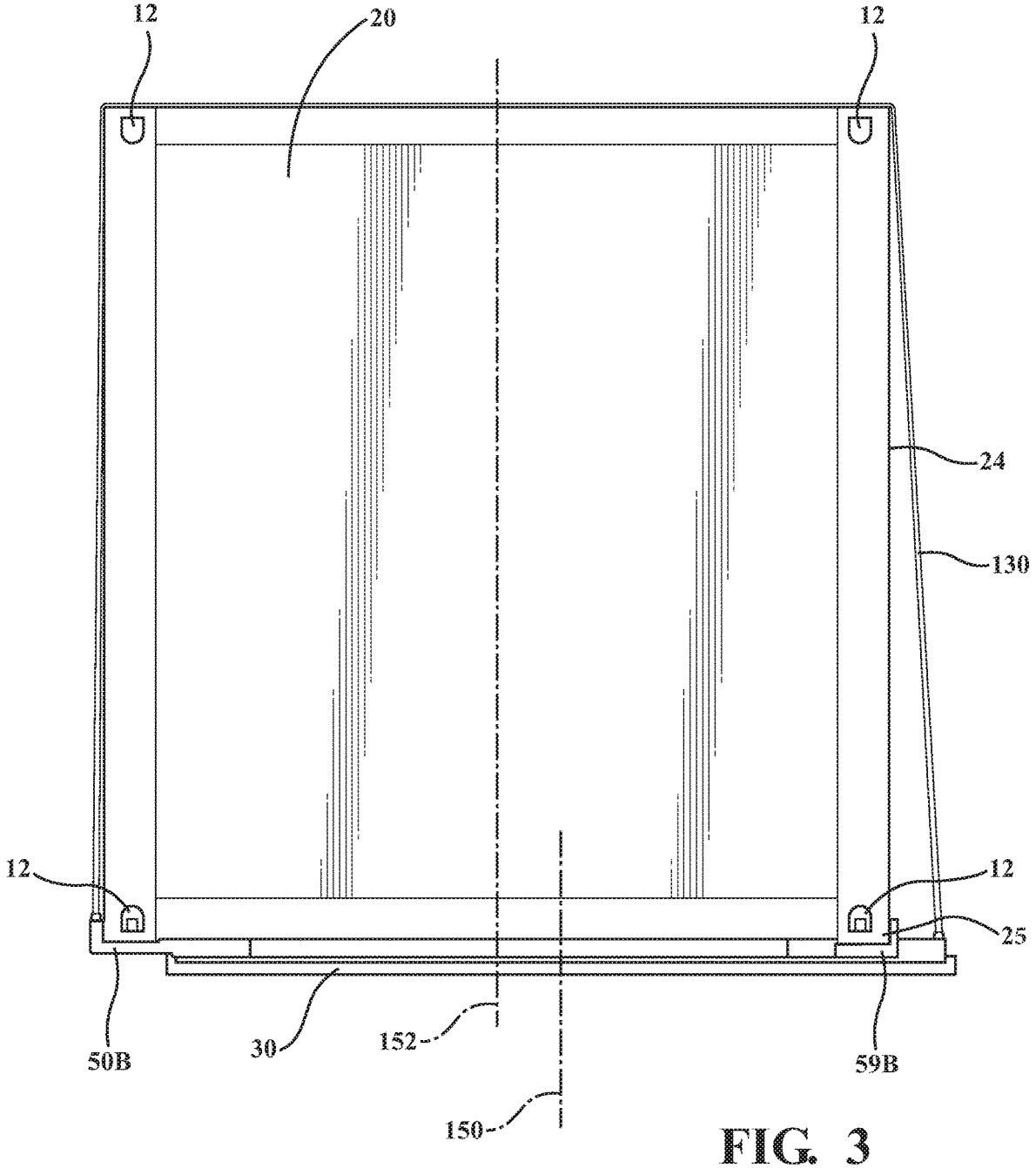
FIG. 3 is a side view of a container, pallet and adapters of the system of the invention.

In FIG. 3, the offset position of the container 20 in relation to the pallet 30 will be better understood. Viewed from one end, the mounting adapters 50B, 59B are shown in their mounted configuration on the pallet 30. As shown in the drawing, the dimensions and configuration of the inboard mounting adapters 59A, 59B are such that the lower edge 25 of one side wall 24 of the container 20 is positioned inboard of one lateral edge of the pallet 30. On the opposite side of the pallet 30, the outboard mounting adapters 50A, 50B are dimensionally longer, measured laterally in relationship to the pallet 30, thereby positioning a guide 60A of the outboard mounting adapters 50A, 50B further from a longitudinal centerline 150 of the pallet 30. As a result, the mounting adapters 50, 59 position a longitudinal centerline 152 of the container 20 in an offset relationship to the longitudinal centerlinecenter line 150 of the pallet 30. The amount of offset may be selected by appropriate selection of the dimensions of the mounting adapters 50A, 50B, 59A and 59B.

Figure 4:
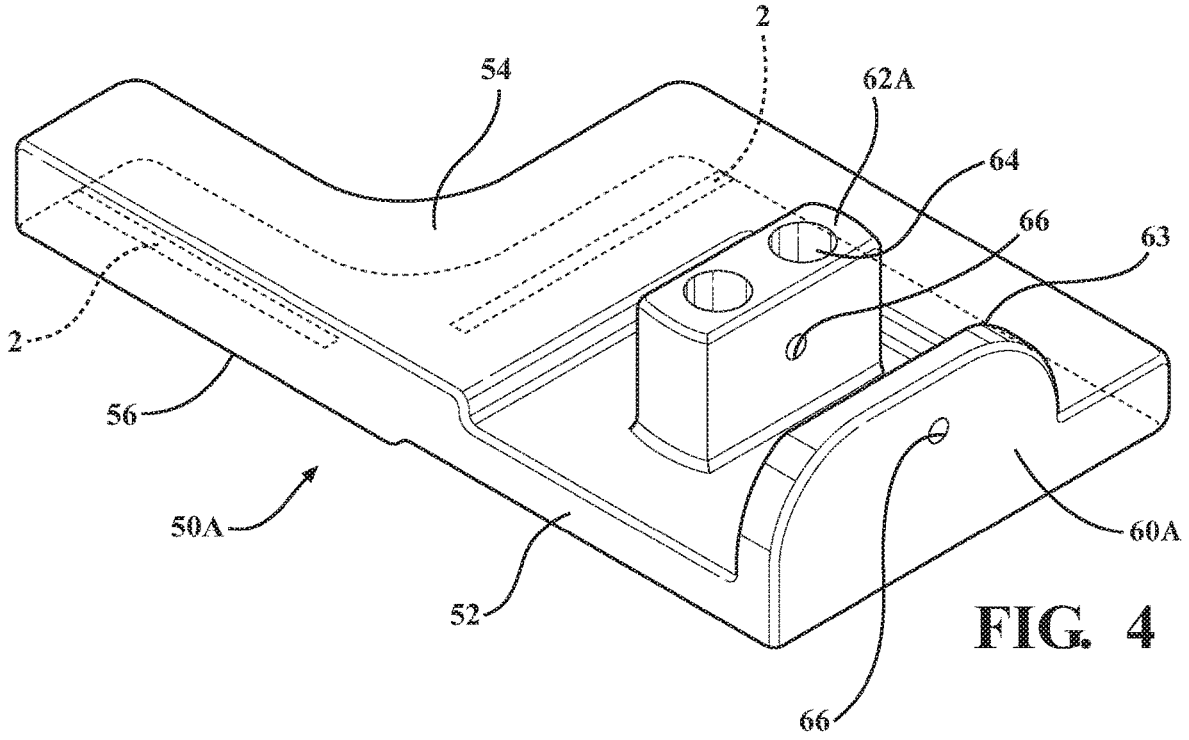
FIG. 4 is a perspective view of a forward outboard adapter as used in the invention.
Figure 5:
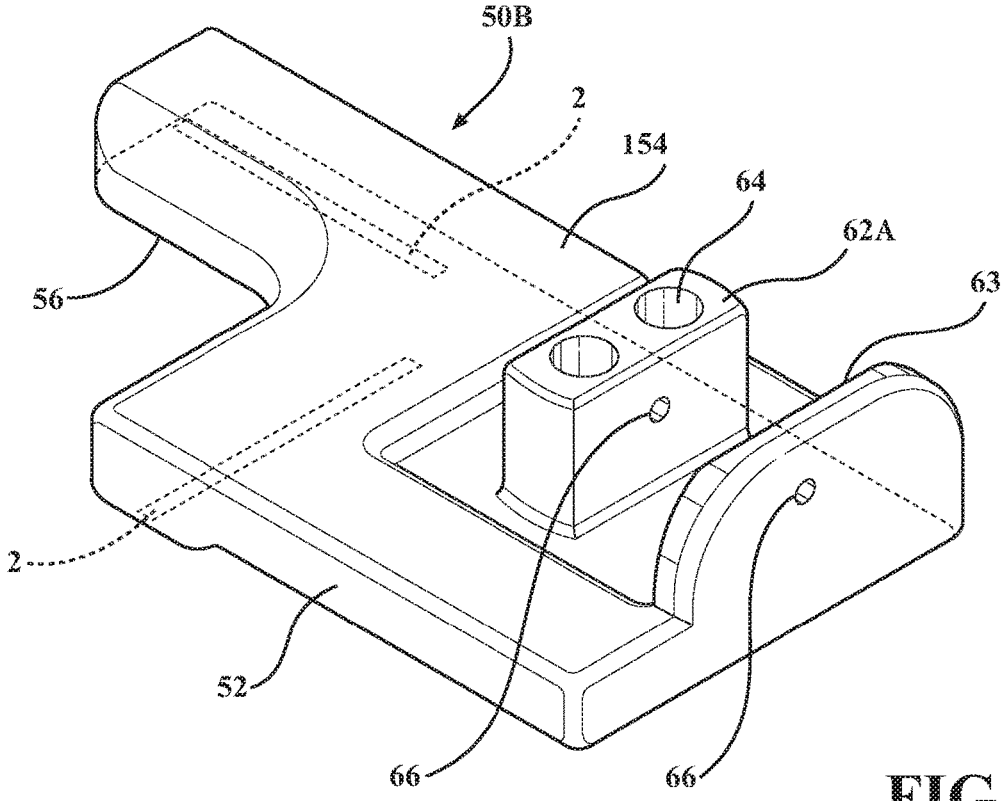
FIG. 5 is a perspective view of a complimentary aft outboard adapter as used in the present invention.
Figure 9:
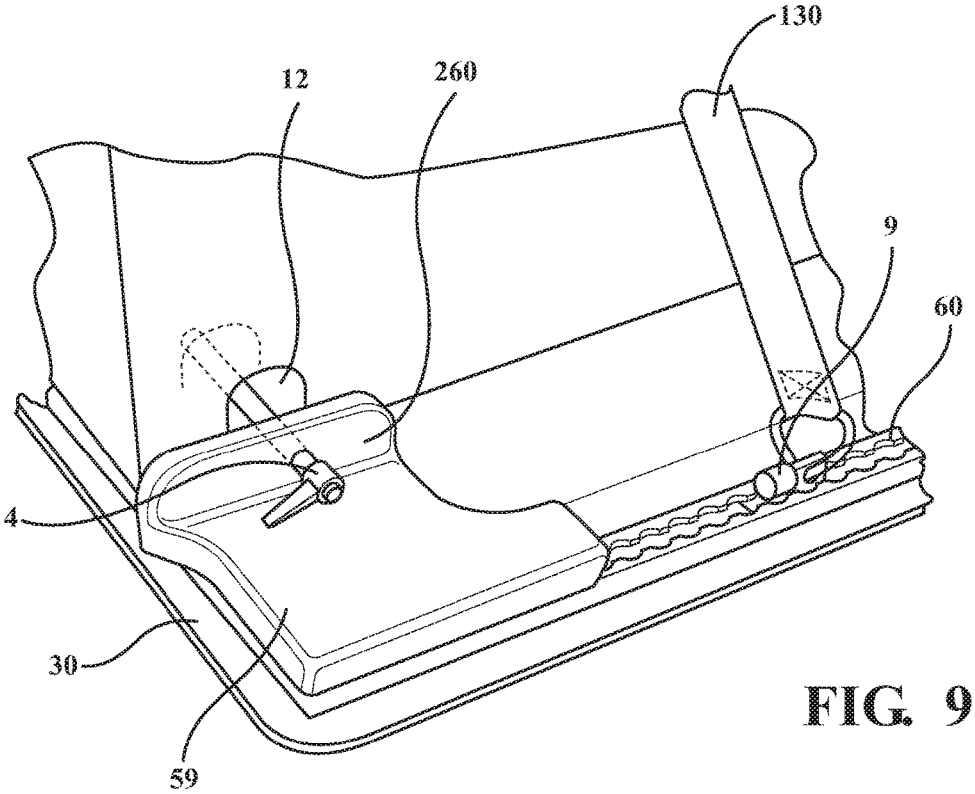
FIG. 9 is a perspective view of the detail of one corner of a container secured to one corner of a pallet.

FIG. 4 depicts the geometry and structure of the forward outboard mounting adapter 50A. FIG. 5 depicts the geometry and structure of aft outboard mounting adapter 50B. It will be appreciated that the outboard mounting adapters 50A and 50B are similar in dimension and configuration, and are essentially mirror images. Identical reference numbers therefore apply to FIG. 5, and to the descriptions which follow. The forward outboard mounting adapter 50A features an upward extending container engaging member 62A which engages a socket 12 in the outboard forward corner of the cargo container 20. One or more through holes or locking bores 66 in the forward outboard mounting adapter 50A accept a locking pin 4 which passes through an opening in the socket 12 in the corner of the container 20 as shown in FIG. 9, as well as through the engaging member 62A of the mounting adapter 50A, thereby securing the container 20 to the mounting adapter 50A. The outboard mounting adapters 50A, 50B are typically monolithic, and formed of lightweight but high strength material such as aluminum. The mounting adapter 50A, in plan view, has a generally "L" shaped base 52 having a top side 154 and an underside 56 and is removably secured to the pallet track 60 in a manner which will be further described herein. When secured to the pallet 30, the outboard mounting adapter 50A is positioned at one of the corners of the pallet 30 as shown in FIG. 2.

Protruding from the top side 154 of the base 52 are the guide 60A and the container engaging member 62A. The container engaging member 62A is formed with lightening holes 64 which serve to reduce the overall weight of the outboard mounting adapters 50A, 50B. The container engaging member 62A is sized and oriented to engage one corner socket of the container 20, thereby restraining the container 20 from movement in relation to the outboard mounting adapters 50A, 50B and the pallet 30. The positioning guide 60A is provided with a bevel 63 which collectively serve to facilitate positioning of the container 20 in relation to the outboard mounting adapters 50A, 50B as the container 20 is lowered into position onto the pallet 30 and the mounting adapters 50A, 50B, 59A and 59B. The engaging members 62A and the positioning guide 60A are further provided with locking pin bores 66. Complimentary locking pin holes are formed in the corners of the container 20. When the container 20 is positioned on the pallet 30 and the mounting adapters 50A, 50B, 59A and 59B, the locking pin holes in the container 20 align with the locking pin bores 66 in the mounting adapters 50A, 50B, 59A and 59B. A locking pin 4 may thus be inserted through the wall of the container 20 and the locking pin bores 66 of the engaging member 62A and the positioning guide 60A, thereby preventing vertical, longitudinal or axial movement of the container 20 in relation to the pallet 30.

It will be appreciated that the outboard mounting adapters 50A, 50B are positioned at a first outboard corner 54 and a second outboard corner 55 in similar fashion.

Figure 6:
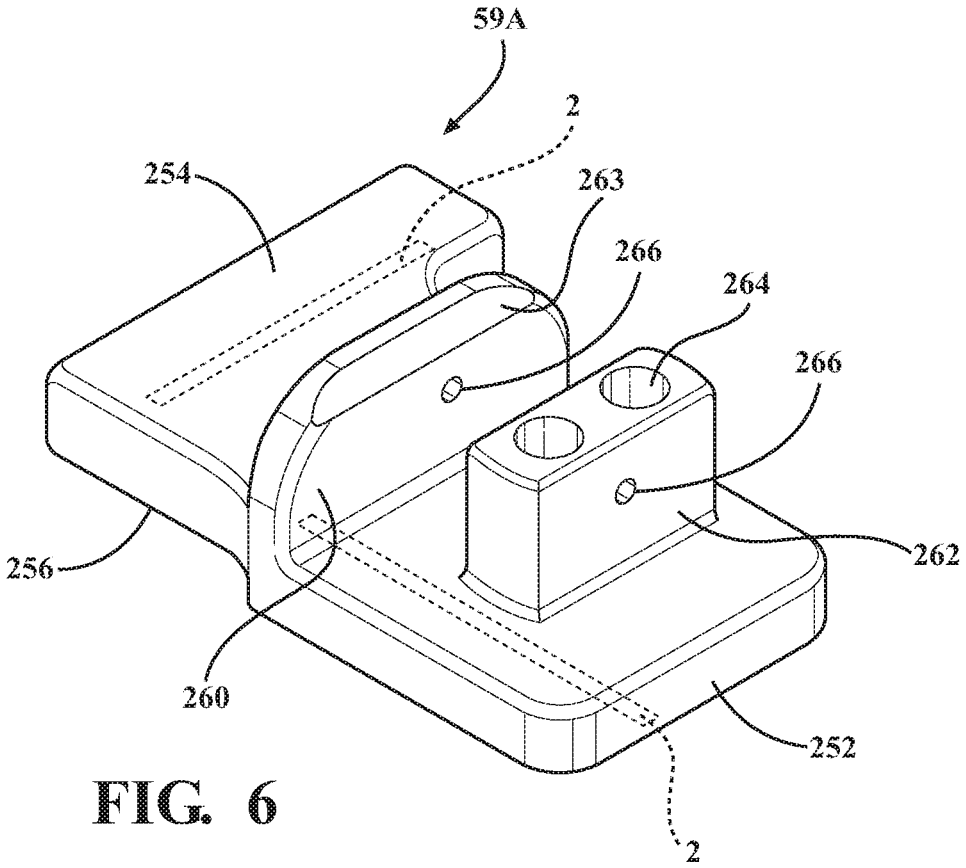
FIG. 6 is a perspective view of a forward inboard adapter as used in the present invention.
Figure 7:
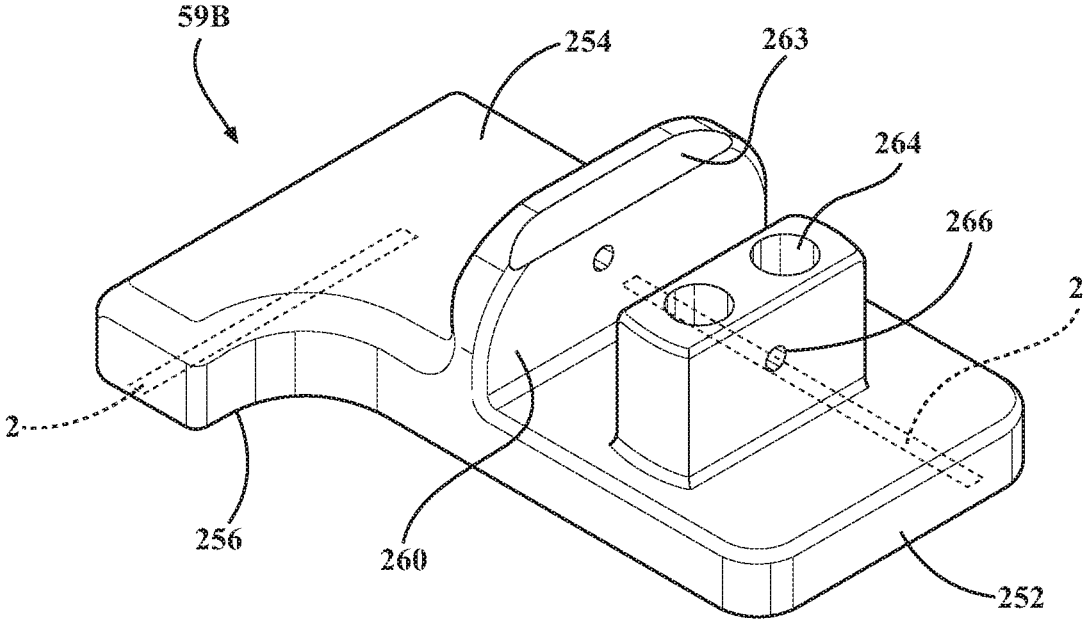
FIG. 7 is a perspective view of a complimentary aft inboard adapter as used in the present invention.

FIGS. 6 and 7 depict the geometry and structure of the inboard mounting adapters 59A, 59B, again with reference to FIG. 2. The inboard mounting adapters 59A, 59B are mirror images of one another, and have a roughly "L" shaped geometry when viewed in plan. The forward inboard mounting adapter 59A features an upward extending container engaging member 262 which engages a socket in the inboard forward corner socket of the cargo container 20. One or more through holes 266 in the forward inboard mounting adapter 59A accepts the locking pin 4 which passes to an opening in the socket 12 in the corner of the container 20 as shown in FIG. 9, as well as through the engaging member 262 of the inboard mounting adapter 59A thereby securing the container 20 to the inboard mounting adapter 59A. The inboard mounting adapters 59A, 59B are typically monolithic and formed of lightweight but high strength material such as aluminum. The inboard mounting adapter 59A in plan view has a generally "L" shaped base 252 having a top side 254 and an underside 256 and is removably secured to the pallet upper track 60 in a manner which will be further described herein. When secured to the pallet 30, the inboard mounting adapter 59A is positioned at one of the corners of the pallet 30 as shown in FIG. 2.

Protruding from the top side 254 of the base 252 are a guide 260 and a container engaging member 262. The container engaging member 262 is formed with lightening holes 264 which serve to reduce the overall weight of the inboard mounting adapters 59A and 59B. The container engaging member 262 is sized and oriented to engage one corner socket of the container 20, thereby restraining the container 20 from movement in relation to the inboard mounting adapters 59A and 59B, as well as the pallet 30. The guide 260 is provided with a bevel 263 which collectively serve to facilitate positioning of the container 20 in relation to the inboard mounting adapters 59A, 59B as the container 20 is lowered into position on the pallet 30 and onto the mounting adapters 50A, 50B, 59A and 59B. The engaging member 262 and the guide 260 are further provided with locking pin bores 266. Complimentary locking pin holes are formed in the corners of the container 20. When the container 20 is positioned on the pallet 30 and the mounting adapters 50A, 50B, 59A and 59B, the locking pin holes in the container 20 align with the locking pin 4 bores 266 and the mounting adapters 50A, 50B, 59A and 59B. The locking pin 4 may thus be inserted through the wall of the container 20 and the locking bin bores 266 of the engaging member 262 and the guide 260, thereby preventing vertical, longitudinal or axial movement of the container 20 in relation to the pallet 30.

It will be appreciated that the inboard mounting adapters 59A and 59B are positioned at the first inboard corner 53 and the second inboard corner 51 of the pallet 30 in a similar fashion. Accordingly, the fore and aft centerline 152 of the container 20 is positioned laterally offset from the centerline 150 of the pallet 30. As a result, one side of the container 20 is positioned to rest on the "foot" of the inboard mounting adapters 59A, 59B, as well as the upper surfaces 101 of the strap brace assemblies 100 as will be described in further detail herein. It will be likewise appreciated that the inboard mounting adapter 59A is positioned at the pallet second end 94 in the same fashion that the first inboard mounting adapter 59B is positioned at the pallet first end 90 of the pallet 30.

By so positioning the opposing outboard mounting adapters 50A, 50B and the opposing inboard mounting adapters 59A, 59B in their respective corner positions on the pallet 30, the container 20 may be offset from the centerline 150 of the pallet 30, yet still be appropriately supported by the pallet 30 and the pallet strap brace assemblies 100. Securement straps 130 may subsequently be installed over the container 20 by securement to the pallet upper and side track 62 as well as to the strap brace assemblies 100 as will be later described.

Figure 8:
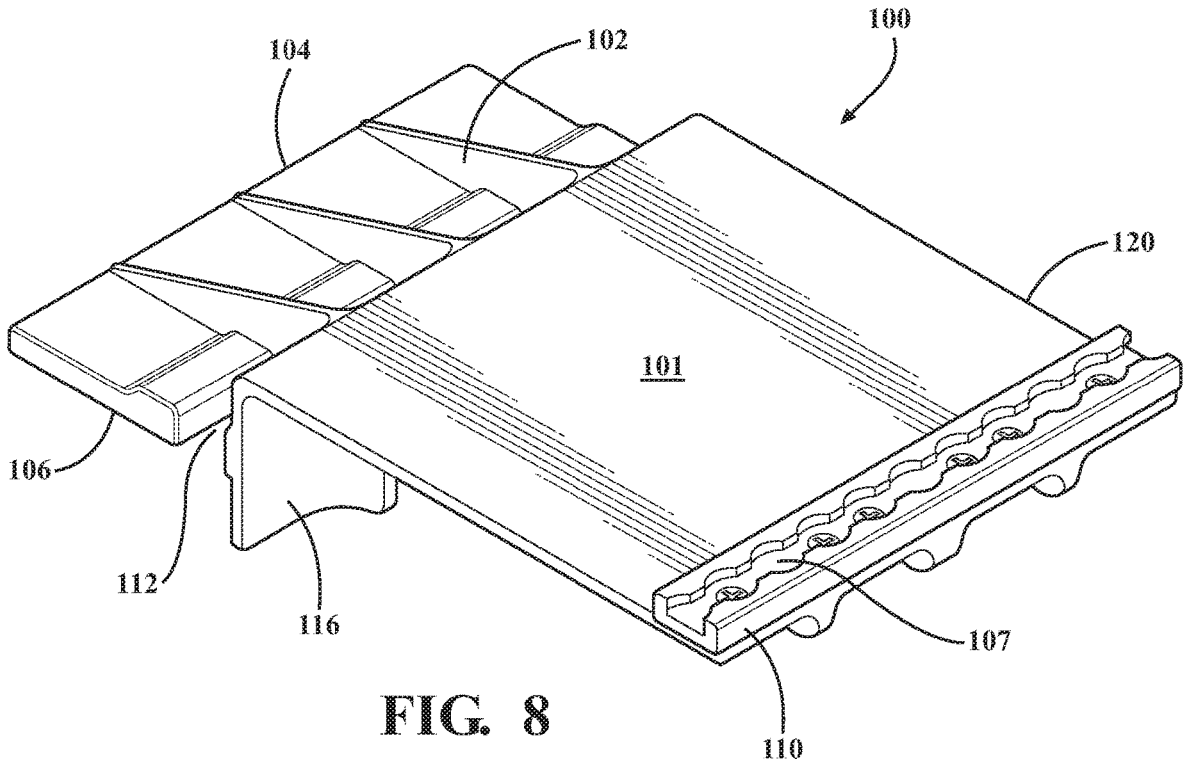
FIG. 8 is a perspective view of a strap brace assembly as used in the present invention.
Figure 10:
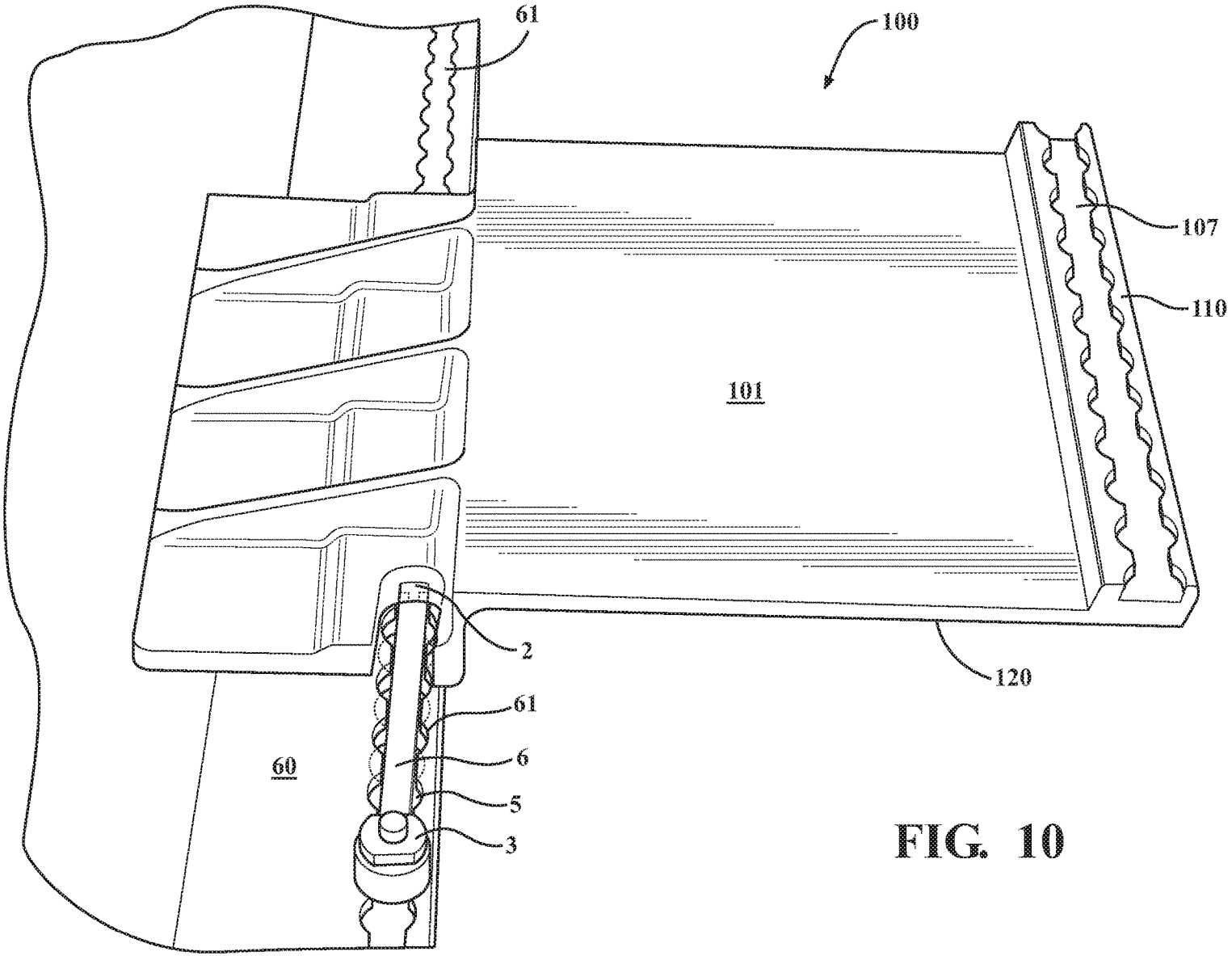
FIG. 10 is a perspective view of the locking bars used in the invention to secure the adapters and strap brace assemblies to the pallet.

As shown in FIG. 8 and FIG. 10, the strap brace assemblies 100 are adapted to be secured to one side of the pallet 30, thereby providing support for the outboard wall of the container 20. Each strap brace assembly 100 is preferably formed of high strength, relatively lightweight material such as aluminum. Each strap brace assembly 100 comprises a container support 120, a flange 104 and a transition section 116. An underside 106 is provided with a slot configured to accept a locking bar 6 engageable with the pallet upper track 60. The transition section 116 may be provided with a plurality of cylindrical protrusions (not visible) configured to engage the pallet side track 62. A slot 112 allows access to the plunger 7 of the locking bars 6. The actuating plunger 3 of the locking bar 6 may be accessed through the slot 112. To provide the necessary strength to bear the loads associated with the containers 20, the support elements 120 and the flange 104 of the strap brace assembly 100 are interconnected by reinforcements 102. When one or more the brace assemblies 100 are accordingly removably affixed to the first side 96 of the pallet 30, strap brace assemblies 100 provide the necessary support for the outboard perimeter of the container 20. Attached to the upper surface 101 of the strap brace assembly 100 is a strap brace track 110 provided with cylindrical cavities 107 suitable for engaging locking bars or locking fasteners to which load straps may be secured.

FIG. 9 is a detailed, close-up view of one corner of the system of the present invention, depicting one adapter 59 secured to the pallet 30, and one end of a strap 130 affixed to the track 60. The fixing pin 4 penetrates the positioning guide 60A and the engaging member 62A as well as the socket 12, thereby fixing the container 20 in relation to the pallet 30. Preferably, the fixing pin 4 is provided with a spring loaded locking ball which selectively locks the pin 4 into fixed relationship with the inboard mounting adapter 59A, 59B.

To secure the lugs and brace assemblies to the perimeter of the pallet 30, locking bars of the type depicted in FIG. 10 are utilized. The interconnection of the locking bars with the pallet tracks 60 is also evident from the details shown in FIGS. 4-7.

Also evident from a study of FIG. 9 is the securement of one end of the strap 130 to the track 60. In the embodiment, the flexible strap 130 is provided with a removable, repositionable anchor 9 at each end of the strap 130. The anchor 9 comprises a cylindrical element complimentary to cylindrical cavities 61, and further comprises a spring loaded release. To attach the anchor 9 to the track 60, the cylindrical element is inserted into a first cavity 61 and positioned intermediate said first cavity 61 and an adjacent cavity 61. Spring loaded release locks the anchor 9 in said intermediate position, in which the anchor 9 is prevented from removal from the track 60. This and other well-known methods for affixing cargo restraints may be used for securing the container 20 to the pallet 30.

FIG. 10 depicts the utilization and structure of the locking bars 6. While FIG. 10 depicts the use of the locking bars 6 in association with the track 60 and the strap brace assembly 100, it will be appreciated that the locking bars 6 engage the mounting adapters 50A, 50B, 59A and 59B in similar fashion. The underside of the strap brace assemblies 100 and the mounting adapters 50A, 50B, 59A and 59B are provided with slots 2 having a "T" profile. The locking bars 6, on their upper side, have a corresponding profile, allowing the locking bars 6 to slide into the slots 2. A plurality of circular sections 5 are formed on the bottom side of the locking bar 6. The sections 5 have a diameter complimentary to the diameter of track cavities 61, and the spacing of the sections 5 corresponds to the spacing of cavities 61. In this fashion, the locking bars 6 may be inserted into the track 60. Once so positioned, the locking bar 6 may be moved in relation to the track 60 so that the centers of the sections 5 and the cavities 61 are no longer in register, thereby preventing extraction of the locking bar 6 from track 60. Locking plunger 3 engages the track 60, thereby preventing lateral movement of the locking bar 6 in relation to the track 60.

As shown in the figures, it will be appreciated that by placement of the mounting adapters 50A, 50B, 59A, 59B and the strap brace assemblies 100, a plurality of flexible straps 130 may be anchored and progressively tightened to restrain the container 20 from movement in relation to the pallet 30.

It will be appreciated, therefore, that in the present invention, a standard pallet constructed for supporting a standard container in the normal configuration wherein the alignment of the longitudinal centerline of the pallet is maintained with the longitudinal centerline of the container, may be temporarily configured to allow a standard intermodal container to be offset from the longitudinal centerline of the pallet, and hence, offset from the pallet so that the exterior of the container is adequately spaced from the interior walls of the cargo compartment in which the container is being transported.

Although specific embodiments of the present invention have been described above, it should be understood that such embodiments are by way of example only and merely illustrative of many possible specific embodiments. Various modifications obvious to those skilled in the art are deemed to be within the scope of the present invention as further defined in the claims which follow.

What we claim as our invention is:

1. An apparatus configured to secure a container on a pallet, an underside of the container having a socket extending into the container, the apparatus comprising:

first and second adapters that are non-identical, mirror images of each other, each adapter incorporating a member and a guide fixedly protruding from separate positions on a base, the base of each adapter removably securable to the pallet, and the member, the guide, and the base being rigid, wherein an edge of the container is receivable between the guide and the member, the edge of the container is adjacent to a corner of the container, the member has an external dimension and cross-section complimentary to an internal dimension and cross-section of the socket, and the member is receivable within the socket; and a first aperture extending through the guide, a second aperture extending through the member that is aligned with the first aperture, and a fastener capable of removably securing the member within the socket via the first aperture and the second aperture.

2. The apparatus of claim 1, wherein the member and the guide protrude from the base of each adapter in a common direction.

3. The apparatus of claim 1, wherein the member and the guide define a receiving space therebetween.

4. An apparatus configured to secure a container on a pallet, an underside of the container having a socket extending into the container, the apparatus comprising:

an adapter incorporating a member and a guide fixedly protruding from separate positions on a base, the base of the adapter removably securable to the pallet, and the member, the guide, and the base being rigid, wherein an edge of the container is receivable between the guide and the member, the edge of the container is adjacent to a corner of the container, the member has an external dimension and cross-section complimentary to an internal dimension and cross-section of the socket, and the member is receivable within the socket;

a first aperture extending through the guide, a second aperture extending through the member that is aligned with the first aperture, and a fastener capable of removably securing the member within the socket via the first aperture and the second aperture; and flexible straps, each having a first end removably securable to a first point on the pallet and a second end removably securable to a second point on the pallet.

5. The apparatus of claim 4 further comprising a strap mounting bracket capable of being movably secured to the pallet.

6. A system configured to secure a container on and in relation to a pallet, the system comprising:

adapters removably attachable to corners of the pallet via a locking member receivable in through holes formed in the adapters, the adapters being engageable with corresponding corners of the container;

strap brace assemblies removably securable to a first lateral side of the pallet;

strap anchors removably securable to a second lateral side of the pallet; and flexible straps each having a proximal end removably securable to one of the strap anchors and a distal end removably securable to one of the strap brace assemblies, wherein when the container is positioned on the pallet, the flexible straps are capable of surrounding sides and a top of the container and securing the container in relation to the pallet with the distal ends of the flexible straps positioned laterally beyond the first lateral side of the pallet.

7. A system comprising:

a pallet;

a container disposed on the pallet and having sockets; and first and second adapters that are non-identical, mirror images of each other, each adapter having a base and a member fixedly protruding from the base, wherein the members are complementary to the sockets of the container, the bases are removably attached to a top surface of the pallet with the members extending away from the pallet, and the members are configured to removably engage the sockets of the container; wherein each of the adapters has a guide protruding from the base that is generally parallel with the member; fasteners removably securing the members to the adapters within the sockets of the container; and wherein the guides and the members of the adapters are provided with apertures extending therethrough.

8. The system of claim 7, wherein the sockets are adjacent to corners of the container.

9. The system of claim 7, wherein the fasteners extend through the apertures of the guides and the members of the adapters.

10. The system of claim 7, wherein edges of the container are disposed between the guides and the members of the adapters when the adapters removably engage the sockets.

11. The system of claim 9, wherein the guides are disposed outside of the container when the adapters removably engage the sockets.

12. The system of claim 7, wherein a longitudinal center axis of the container is offset from a longitudinal center axis of the pallet.

13. A system comprising:

a pallet;

a container disposed on the pallet and having sockets;

adapters each having a base and a member fixedly protruding from the base, wherein the members are complementary to the sockets of the container, the bases are removably attached to a top surface of the pallet with the members extending away from the pallet, and the members are configured to removably engage the sockets of the container;

strap brace assemblies removably secured to a first lateral side of the pallet; and flexible straps each having a first end removably secured to one of the strap brace assemblies and a second end removably secured to a second lateral side of the pallet, wherein the flexible straps surround sides and a top of the container securing the container in relation to the pallet.

14. The system of claim 13, wherein the strap brace assemblies extend laterally beyond an outer periphery of the pallet.

15. The system of claim 14, wherein at least one of the first ends of the flexible straps is removably secured to one of the strap brace assemblies at a point laterally beyond the outer periphery of the pallet.

16. The system of claim 14, wherein the first ends of the flexible straps are removably secured to the strap brace assemblies at points laterally beyond the outer periphery of the pallet.

17. The system of claim 16, wherein the second ends of the flexible straps are removably secured to the second lateral side of the pallet at points within the outer periphery of the pallet.

18. The system of claim 17, wherein a longitudinal center axis of the container is offset from a longitudinal center axis of the pallet.

* * * * *